US005349569A

United States Patent [19]

Tanaka

[11] Patent Number: 5,349,569

[45] Date of Patent: Sep. 20, 1994

[54] TIMING SYSTEM FOR SWIMMING RACE

[75] Inventor: Hiroshi Tanaka, Tokyo, Japan

[73] Assignee: Seiko Instruments Inc., Japan

[21] Appl. No.: 22,368

[22] Filed: Feb. 25, 1993

[30] Foreign Application Priority Data

Feb. 28, 1992 [JP] Japan ..... 4-043977
Jul. 14, 1992 [JP] Japan ..... 4-186764
Jul. 15, 1992 [JP] Japan ..... 4-188244
Jul. 20, 1992 [JP] Japan ..... 4-192538

[51] Int. Cl.[5] ..... G04B 47/00; G04F 8/00; H01H 35/00

[52] U.S. Cl. ..... 368/10; 368/110; 4/496; 200/52 R; 200/85 R

[58] Field of Search ..... 308/3, 9, 10, 110–113; 4/496, 497, 505; 200/52 R, 85 R, 86 R, 243, 264

[56] References Cited

U.S. PATENT DOCUMENTS 3,590,181 6/1971 Baran ..... 200/52
3,678,496 7/1972 Stalp ..... 340/523
3,781,529 7/1973 Abramson et al. ..... 235/927
3,784,768 1/1974 Hunt ..... 200/52 R
3,916,214 10/1975 Coble, Jr. et al. ..... 307/119
3,920,940 11/1975 Brown et al. ..... 200/52 R
3,944,763 3/1976 Beierwaltes ..... 200/52 R
4,292,696 10/1981 Berger ..... 4/505
4,456,383 6/1984 Speckhart et al. ..... 368/9
4,518,266 5/1985 Dawley ..... 368/10
5,136,621 8/1992 Mitchell et al. ..... 377/5

*Primary Examiner*—Vit W. Miska
*Attorney, Agent, or Firm*—Bruce L. Adams; Van C. Wilks

[57] ABSTRACT

A timing system for swimming race which records, displays, and prints the time of race. To provide a mask circuit in a control device which controls each signal, enables the timing system to exactly perceive a swimmer's touch. Furthermore, a top edge panel is provided on a touch panel so as to perceive a swimmer's touch at an oblique angle. A plurality of lane boxes are provided for backup of a touch signal and a starting block signal, in case of failure and misoperation of the control device. Further, a visual display device is provided in order that a swimmer can recognize a starting signal visually.

20 Claims, 6 Drawing Sheets

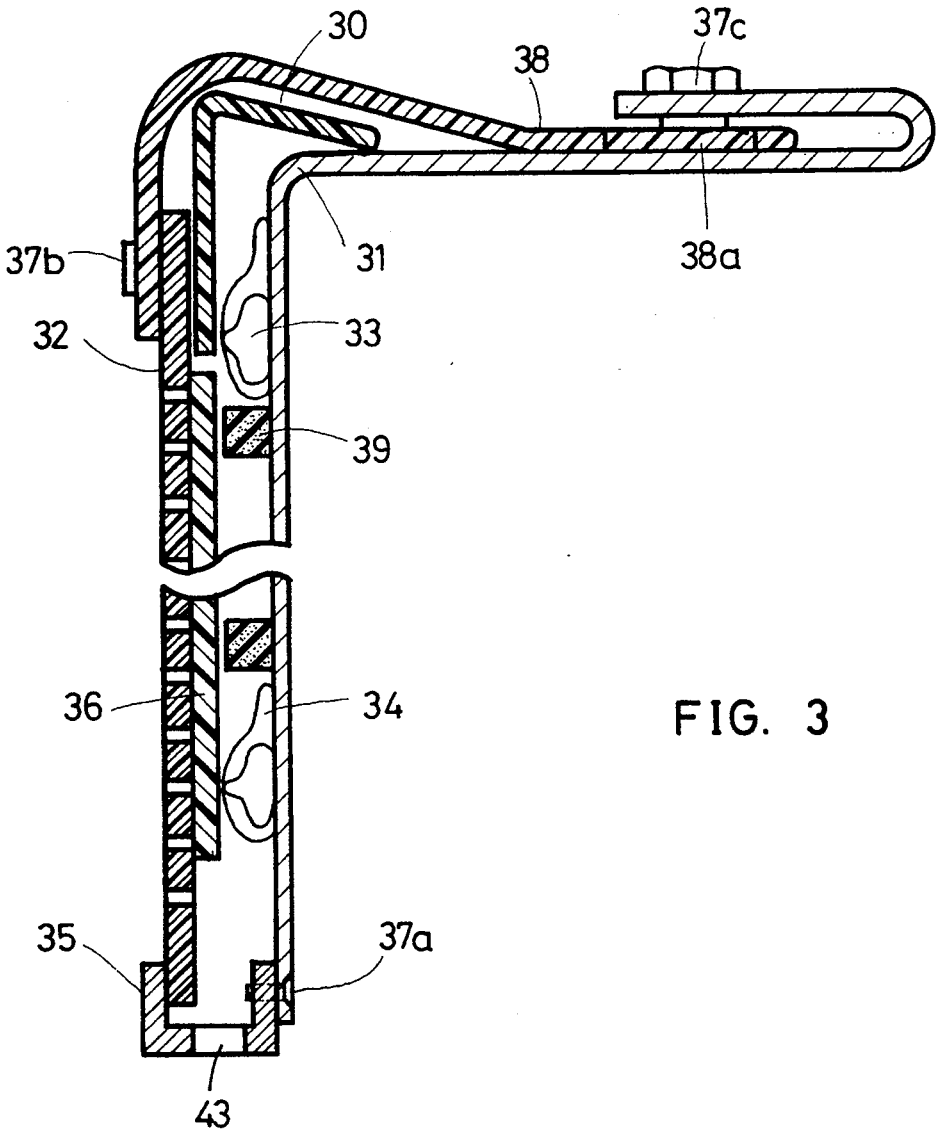
FIG. 3
FIG. 4
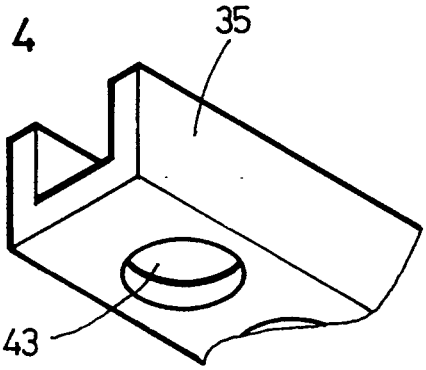
FIG. 5
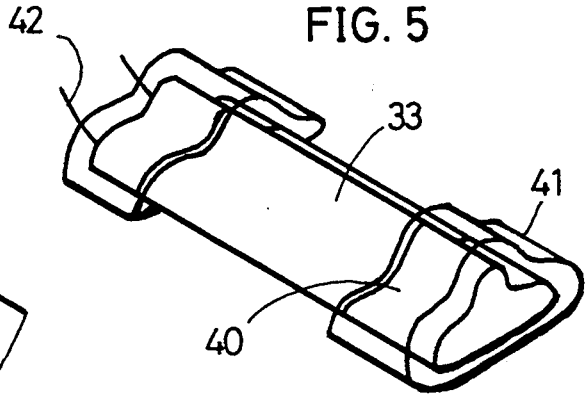

TIMING SYSTEM FOR SWIMMING RACE

BACKGROUND OF THE INVENTION (1) Field of the Invention

This invention relates to a timing system for a swimming race.

(2) Description of the Related Art

In a conventional timing system for a swimming race, when a swimmer starts at a signal such as a pistol, a control device which perceives a starting signal from a starting signal generator, i.e., the pistol, and a touch signal from a touch panel calculates a time difference between the starting signal and the touch signal by a timing circuit and a calculating circuit. As a result, time is displayed by a display device and output to a printer.

However, the conventional system occasionally times a wrong lap time and finish time.

For instance, since the device has to perceive a touch signal even if a swimmer touches lightly in a swimming race, the device often perceives even a touch signal caused by a splash or a fluctuation of water pressure. In a relay, when a former swimmer touches a touch plate so as to get out of the swimming pool after a next swimmer dives into the swimming pool, the device records a wrong lap time. As stated above, the timing system works wrong by an accidental touch of a next swimmer or a former swimmer.

In a structure of the conventional touch panel, an electrical contact section such as a conductive rubber or a tape switch is provided, and a front panel which a swimmer touches pushes a switch directly.

Since a touch panel for a timing device in a swimming race is used while being soaked in water, which is a severe condition for electrical devices, a water resisting property of the electrical contact section deteriorates heavily, trouble occurs easily and its repair is difficult. A frame of the conventional touch panel is integrated into a rear panel, suspended vertically along a side wall of a swimming pool with a rear panel to which an electrical contact section adheres and a front panel comprising an spacer, and fixed there. Since the electrical contact section is fastened to a panel, the front panel must be removed in order to repair an electrical contact section.

A regulation of the FEDERATION INTERNATIONALE DE NATATION AMATEUR requires a top edge panel of the timing device to be sensitive. To be sensitive means to be able to activate a signal by a touch from the top. That's because a swimmer having long arms and or a swimmer of the backstroke sometimes touch a top edge of a pool.

Therefore, besides a switch at the front side, another switch is provided at the inside of an upper edge of the front panel in a touch panel used for an international meet.

However, in a touch panel having the above structure, the tape switch is activated sharply by any touch. Therefore the exact time cannot be recorded because the top edge panel is activated mistakenly by unexpected incidents such that materials are on the top edge panel and the feet of the officials touch the top edge panel.

A unit of a timing system is operated usually at a domestic meet. However, a backup is necessary in case of any trouble and mis-operation at an international meet. It is indispensable for a timekeeper to record the exact time without fail. No failure and mistake can be allowed. However, only one unit of a timing system would be helpless if the time data disappeared.

A number of wiring should not be so increased to prepare a backup for timing, because a lot of wiring around a pool directly connected to the several units of a timing system is dangerous.

As stated above, it is necessary for the timing system not to perceive a wrong touch signal but to perceive a touch signal by a swimmer's touch at an oblique angle. Furthermore, maintenance of a touch panel should be easy and a backup should be prepared in case that a main unit of a timing system is out of order or malfunctions.

In addition, there is another requirement to enable a swimmer to see a starting signal as well as to hear.

SUMMARY OF THE INVENTION

An object of the present invention is to provide a timing system for a swimming race which records time exactly and does not work wrongly.

Another object is to provide a timing system for a swimming race which has an efficient touch panel which is not actuated by a touch at a right angle but actuated by a swimmer's touch at an oblique angle.

A further object is to provide a timing system which can supply a backup in case of disorder of a control device and misaction.

As well, it is also an object to provide a timing system having a visual display device which enables auditorily handicapped swimmers to know the starting signal, in addition to give the starting signal by sound.

In order to achieve the above objects, a top edge panel is provided at the upper part of a touch panel. An acrylic resin plate is disposed between the top edge panel and a rear panel so as to contact with a tape switch. As a result, the acrylic resin plate is shaped into the shape of a letter L. Therefore, the touch panel can perceive a touch signal if a swimmer touches at an oblique angle.

A starting block signal from a starting block and a touch signal from a touch panel are inputted to a signal distributor equipped at every lane. Each signal is distributed into both a main course box and a sub course box. Therefore, even if a main course box is out of order the data remains in the sub course box.

A visual display device such as a lamp, a display panel, and a flash lamp give the starting signal visually by means of a ready signal and a start signal.

For the structure stated above, the timing system of the present invention can record, display, and print out swimming time exactly.

BRIEF DESCRIPTION OF THE DRAWINGS

FIG. 3 is a sectional view showing a touch panel of the present invention;

FIG. 4 is a perspective view showing a part of a frame of the touch panel having holes;

FIG. 5 is a perspective view of a tape switch having adhesive portions at both ends;

DETAILED DESCRIPTION OF THE PREFERRED EMBODIMENTS

Figure 1:
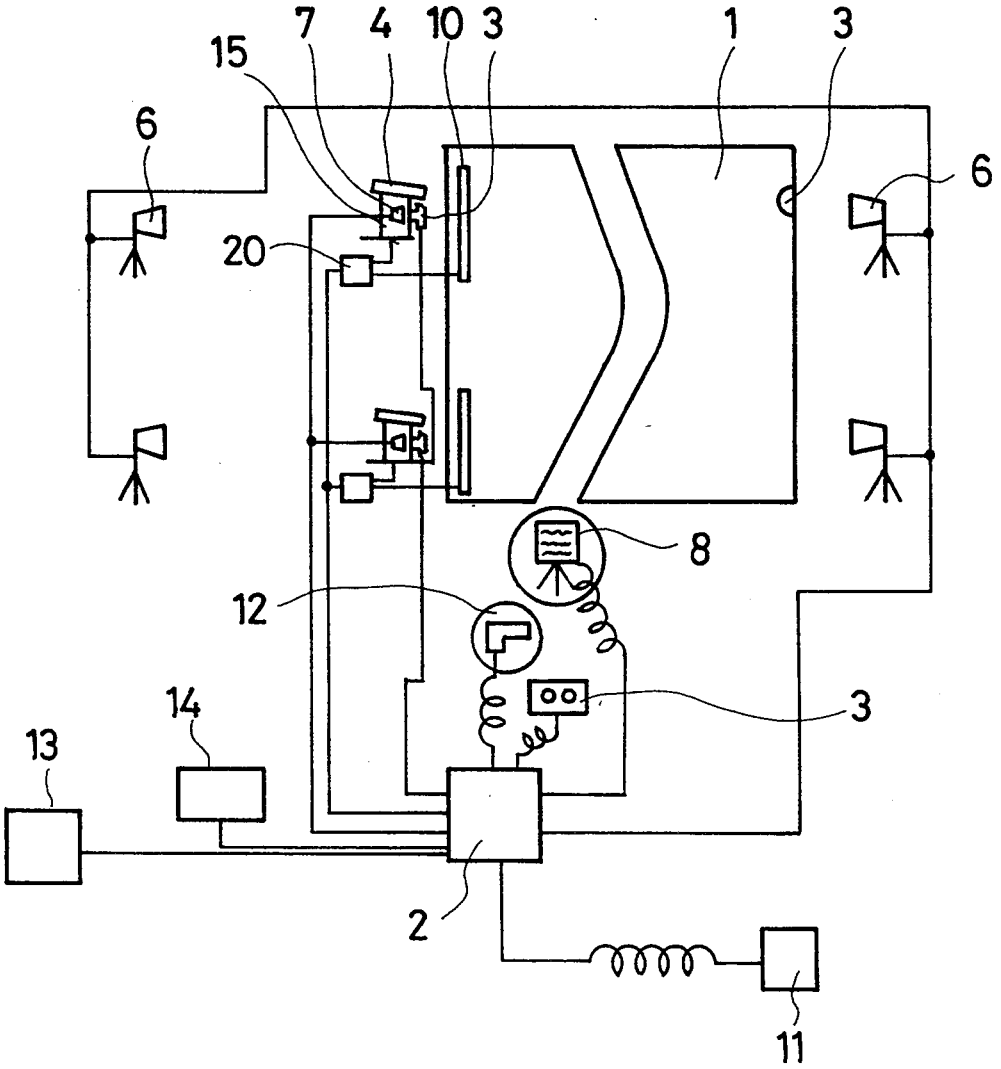
FIG. 1 is a timing system according to block diagram of the present invention.

Referring to the drawings, the detail of the present invention will be explained below.

FIG. 1 is a block diagram of the present invention. A starting block 4 and a touch panel 10 are disposed at the poolside of a swimming pool 1 for each course. When swimmers start, a start signal generated from a start signal generator 12 is inputted into a control device 2.

A starting block signal generated from a starting block signal generator 15 and a touch signal generated from the touch panel 10 are sent through a lane box 20 and inputted into the control device 2. The control device 2 records time. The recorded time is outputted to a printing device 13 and a display device 14. Furthermore, a signal from the control device 2 is inputted to a visual display device such as signal lamps 3, signal display panel 8, and a strobe flash lamp 6.

Figure 2:
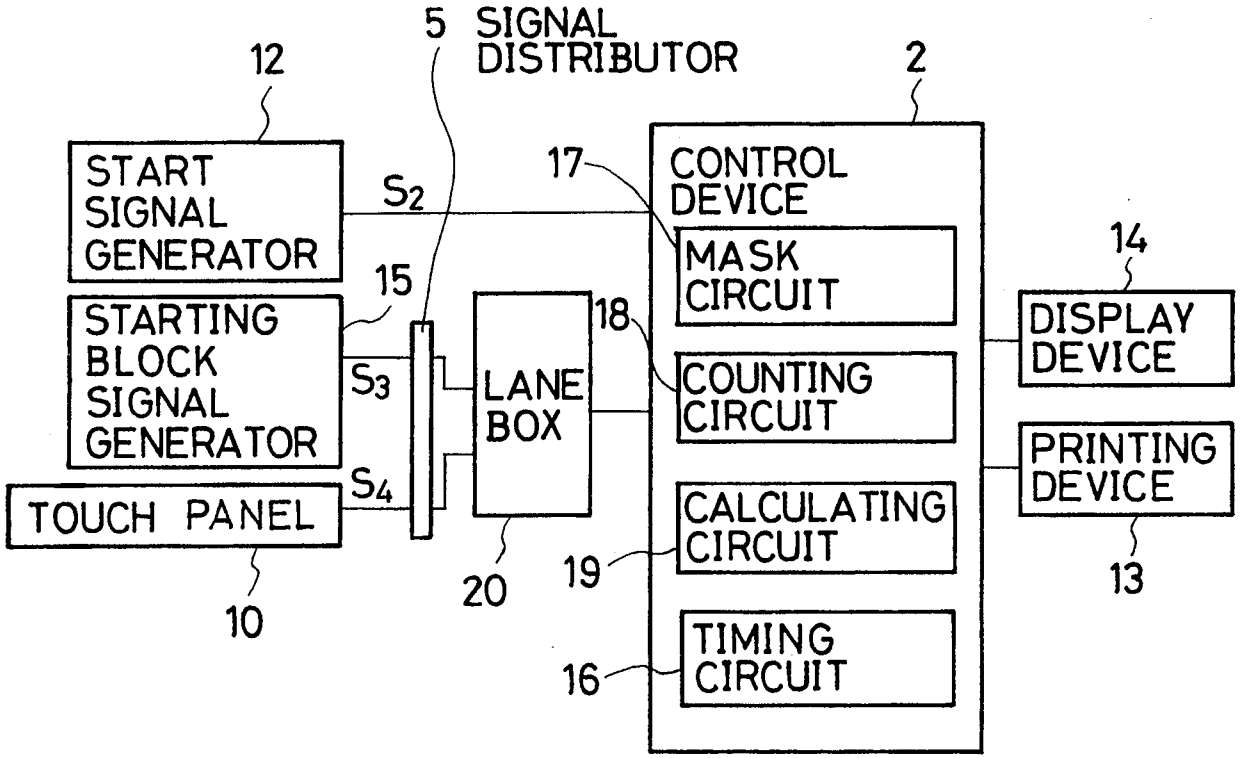
FIG. 2 is a block diagram showing the devices shown in FIG. 1.

Next, referring to FIG. 2, the timing sequence to perceive a signal and an action of each device will be explained. Suppose that a start signal from the start signal generator 12 is S2 and that a starting block signal from the starting block signal generator 15 is S3. S2 is directly inputted to the control device 2 and a timing circuit 16 starts to work. S3 is inputted to each course box after being fed through a signal distributor 5. Then S3 is inputted to the control device 2. S2 and S3 are inputted to the control device 2, and the timing circuit 16 and a calculating circuit 19 calculate the time difference between S2 and S3. Since the result of this calculation is recorded on the printing device 13, the reaction velocity based on the starting signal can be examined.

Similarly, suppose that a touch signal from the touch panel 10 is S4. By calculating the time difference between S4 and S3, relay timing from a swimmer to the next swimmer can be examined. So, swimmers can make use of practice at relay timing.

When S3 is inputted to the control device 2 a mask circuit 17 masks and inactivates S4. Therefore, even if the next swimmer touches the touch panel 10 by mistake, a touch signal is inactivated and not recorded.

However, when the next swimmer steps up onto a starting block, S3 cancels the masking of S4 done by the mask circuit 17 of the control device 2. As a result, S4 gets effective. That is to say, when S4 is generated by a former swimmer and S3 is generated by the next swimmer, the control device 2 realizes that there is no swimmer on a starting block and inactivates S4 again.

Therefore, the control device 2 can easily distinguish a premature start and does not work in response to a wrong touch signal.

Next, referring to FIG. 3, an embodiment of the touch panel 10 in the present invention will be explained below. FIG. 3 is a transverse cross section of a touch panel 10 which is an embodiment of the present invention. The touch panel 10 is provided under the starting block of each course and goes down vertically along the inside wall of a swimming pool. A rear panel or member 31 is spaced apart from a front panel or member 32 in the touch panel 10. A plurality of tape switch sheaths 34 are provided horizontally on the surface of the rear panel 31. A tape switch 33 is housed in each of the tape switch sheath 34 so that it can be drawn. A plurality of switch activating blocks 36 in the shape of a stick are provided on the inside of the front panel 32 opposing the rear panel 31 so that the switch activating blocks 36 and the tape switches 33 cross vertically.

The front panel 32 is an elastic plate having small holes to drain water. When a swimmer hits the front panel 32 the switch activating block 36 moves horizontally rearwardly toward the rear panel 31, which turns the tape switch 33 on. Then a touch signal is outputted. Spacers 39 for controlling sensitivity are disposed separately on the rear panel 31. A U-shaped frame 35 which can be removed easily is provided on the side or the base of the touch panel 10 so that the front panel 32 is not much separated from the tape switch 33. Therefore the frame 35 defines the thickness of the touch panel 10.

The frame 35 is fixed to the rear panel 31 with several screws 37*a* so that the frame 35 can be removed easily from the touch panel 10 by removing the screws. Therefore, in case of trouble with the tape switch 33, it is possible to change the tape switch 33 without pulling the touch panel 10 from the water.

The frame 35 has a plurality of drainage holes 43 as shown in FIG. 4. Usually the touch panel 10 is used in the water, however, since it is electrical equipment it needs to dry out as much as possible. It is easy to drain water out quickly and to dry up the inside of the touch panel 10 by providing the holes 43 so as not to deteriorate the strength of the frame 35 as shown in FIG. 4.

A most frequent trouble of the touch panel 10 is that the tape switch 33 is broken and malfunctions. It is especially important to waterproof the tape switch 33 because the electrical contact portion of the tape switch 33 is soaked in water for a long time. Waterproofing of the embodiment of the present invention, which is shown in FIG. 5, is as follows. Both edges of the tape switch 33 are welded by high frequency, welding which is a welding portion 40. Furthermore, the welding portion 40 is coated with a sealing material such as an epoxy resin, which is a sealing portion 41.

As shown in FIG. 3, a top edge panel or member 38 is disposed movably on the top of the touch panel 10 so as to be removed easily. One end of the top edge panel 38 is fastened to the front panel 32 with a screw 37*b* and the top edge panel 38 itself is bent along the rectangular portion of the rear panel 31. The other end of the top edge panel 38 lies on the horizontal or support portion of the rear panel 31. The top edge panel 38 is composed of an elastic material. The end portion 38*a* of the top edge panel 38 can slide on the horizontal portion of the rear panel 31 guided by a screw 37*c*.

The front panel 32 is separatable from the top edge panel 38, so both of them can be removed easily. Elastic biasing means comprised of an acrylic resin plate 30 composed of an elastic material is provided between the bent portion of the top edge panel 38 and that of the rear panel 31. The acrylic resin plate 30 has first and second portions interconnected by a bent portion, and the bent portion of the acrylic resin plate 30 has a more acute angle than that of the top edge panel 38. Therefore the bent portion of the acrylic resin plate 30 is located under the top edge panel 38. One end of the acrylic resin plate 30 is provided as an actuating portion so as to touch elastically the tape switch 33. The other end of the plate 30 is on the horizontal portion of the rear panel 31.

The force of elasticity of the acrylic resin plate 30 is applied outward and it pushes or biases the top edge panel 38 vertically upwardly. In this structure, the force is applied from one end of the acrylic resin plate 30 against the tape switch 33 even without other force from the outside. However, this force does not turn the tape switch 33 on. When a swimmer touches the front panel 32, the horizontal force is applied toward the front panel 32. Then the tape switch 33 which is provided on the rear panel 31 is pushed and operates. A touch signal is inputted from a lead wire 42 which is shown in FIG. 5 to the timing circuit 16 which is provided in a control device 2.

Next, when a swimmer touches the top edge panel 38, the force is applied obliquely to the top edge panel 38. But the horizontal force is also applied and so the tape switch 33 works as stated above. Namely, the acrylic resin plate 30 functions as a switch activating block, operates the tape switch 33, and activates the timing circuit 16.

A normal function caused by a touch of swimmers is stated above. The case that an unexpected force is applied to the top edge panel 38 by wrong action such that something is put on the top edge panel 38 will be stated below. It is the vertical force that is applied to the top edge panel 38. Therefore this vertical force pushes the top edge panel 38 down against the upward force of elasticity exerted by the acrylic resin plate 30. Consequently, the bent portion of the acrylic resin plate 30 is pushed down and the lower end of the acrylic resin plate 30 which is on the tape switch 33 slides downward. The tape switch 33 is pushed slightly inwardly by the flexure of the acrylic resin plate 30 at that time but not enough to actuate the switch. However, the tape switch 33 does not work in this case.

By providing the above structure, the touch panel 10 does not malfunction even if something other than a swimmer touches the top edge panel 38.

Next, referring to FIGS. 6 and 7, an embodiment of a start signal generating system for a swimming race relating to the present invention will be explained below.

Figure 6:
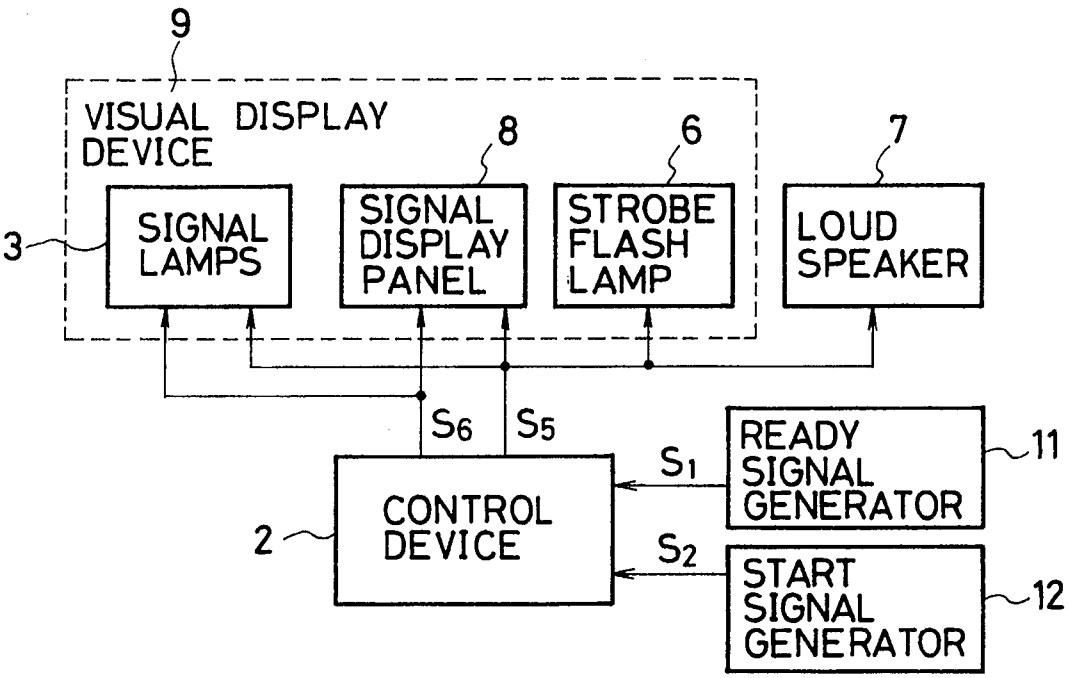
FIG. 6 is a system block diagram showing a visual start signal generating system.
Figure 7A:
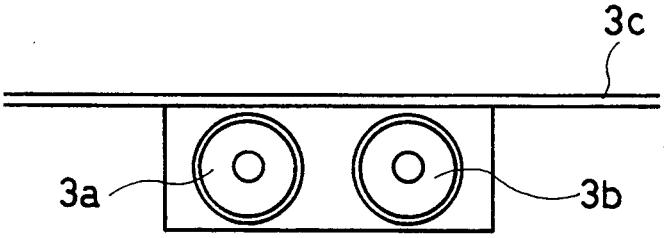
FIG. 7A is an elevational view of signal lamps which constitute one embodiment of the visual start signal generating system shown in FIG. 6.
Figure 7B:
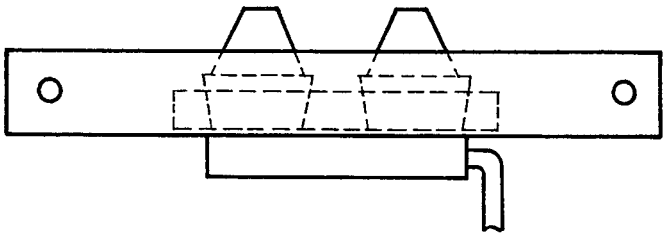
FIG. 7B is a top view of the signal lamps shown in FIG. 7A.

FIG. 6 is a system block diagram showing a visual start signal generating system of the present invention. FIGS. 7A and 7B show an embodiment of signal lamps 3 which is shown in FIG. 6. As shown in FIG. 6, when operators turn a ready signal generator 11 on, a signal S1 is outputted to a control device 2. The control device 2 outputs a signal S6 to the signal lamps 3 and a signal display panel 8. The signal lamps 3 turn green and the signal display panel 8 displays "READY", in order to show that the start condition is ready. When a signal S2 is outputted by the operation of a starter from a start signal generator 12 to the control device 2. The control device 2 outputs a signal S5 to the signal lamps 3, the signal display panel 8, a strobe flash lamp 6 and a loudspeaker 7 through a cable, whereupon, the signal lamps 3 turn red and the signal display panel 8 displays "GO".

Next, referring to FIG. 1, the embodiment of the visual start signal generating system of the present invention applied to swimming race will be explained below. The signal lamps 3 for a swimmer is equipped at a starting block 4 which is provided at the starting side of a swimming pool 1 so as to project at the front of the starting block 4. Therefore a swimmer can see the display of the signal lamps 3 while standing on the starting block 4.

The loudspeaker 7 is included inside of the starting block 4. Swimmers can recognize a ready signal and a start signal not only visually but also auditorily. Furthermore, it is preferable to provide the signal lamps 3 at the turn side of a swimming pool so that swimmers can see signals from the turn side. Another unit of the signal lamps 3 is provided at a side of the swimming pool so as to be adjacent to the start signal generator 12. The signal lamps 3 and the start signal generator 12 are connected to the control device 2 with cables.

The ready signal generator 11 is disposed at the seats of operators and is connected to the control device 2 with cables. The signal display panel 8 is located poolside for the sake of an audience and the person concerned in the race. The strobe flash lamps 6 are provided at the back of the starting block 4 and at the turn side. The strobe flash lamps 6 are connected to the ready signal generator 11 and the start signal generator 12 through the control device 2 so as to work in response to a start signal.

In this embodiment, a ready lamp **3*a* and a start lamp 3*b* are red and green, respectively. The signal lamps 3** in this embodiment are exchangeable for a LED display device.

The signal lamps 3 are provided on the inside wall of the swimming pool as well so that a swimmer can see a display if he starts under water. Of course, the signal lamps 3 are waterproof. The signal display panel 8 is located at the poolside so that it can be seen by the swimmers. It displays "READY" and "GO". When the red lamp of the signal lamps 3 is turned on, the signal display panel 8 displays "READY" at the same time. For an international meeting, a display should be written in other languages than Japanese.

Next, a starter inputs a start signal from the start signal generator 12 to the control device 2. A pistol included in the start signal generator 12 can be used for generating a start signal. It is available to generate a start signal so that a sensor perceives a sound of a pistol. The sensor should be covered with a filter so as not to react to cheers of the audience and noises around the sensor. When a start signal is inputted to the control device 2, the signal lamps 3 switch from the ready lamp **3*a* to the start lamp 3*b*. Simultaneously, the signal display panel 8 switches its display from "READY" to "GO". Furthermore, the strobe flash lamps 6 which are disposed at the front and the backside of a swimmer begin to flash, and a starting sign can be heard in an electronic sound from the loudspeaker 7**.

As stated above, the ready sign is indicated by character display and lamp display. As well, the start sign is indicated by character display, lamp display, flash and a sound. This embodiment is of a swimming race, however, it can apply to track and field.

Figure 8:
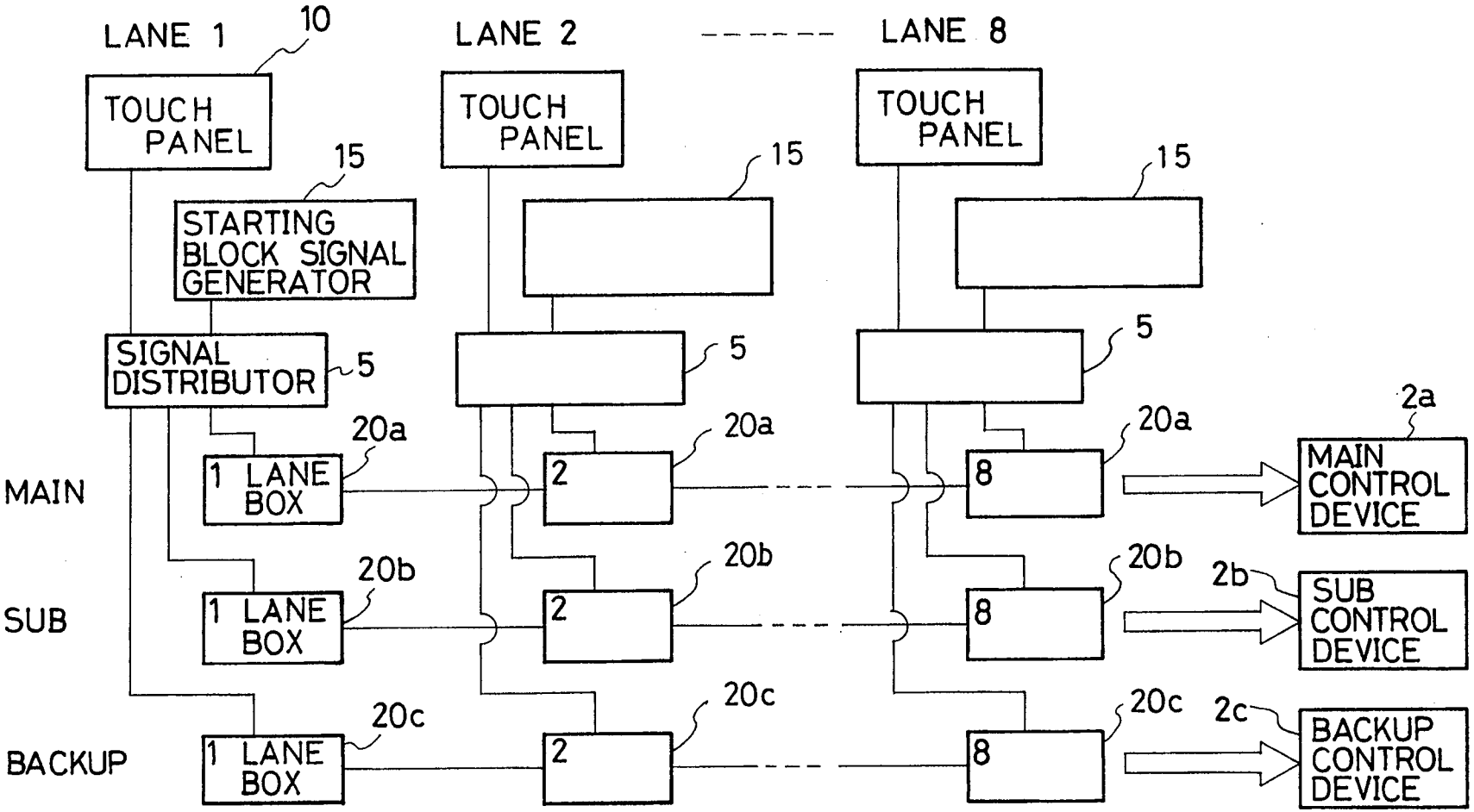
FIG. 8 is an explanatory diagram showing signal distributors, lane boxes, and control devices.

Next, referring to FIG. 8, the connection between signal distributors and lane boxes will be explained below. Signal of a touch panel 10 and a starting block signal generator 15 are inputted to a signal distributor 5 provided for each lane of a swimming pool. The signal distributor 5 connects with three types of lane boxes, namely, a main lane box **20*a*, a sub lane box 20*b* and a backup lane box 20*c***. The same type of lane boxes connects serially and finally connects with a control device for each type.

Therefore, even if the main lane boxes malfunction, the sub lane boxes record time. Further, even if both of the main lane boxes and the sub lane boxes malfunction, the backup lane boxes record time.

What is claimed is:

1. A timing system for a swimming race comprising:

a start signal generator for generating a start signal of a swimming race;

a starting block signal generator provided at a starting block for generating a starting block signal in response to a swimmer's feet leaving from said starting block;

a touch panel suspended along the wall of a swimming pool for generating a touch signal in response to a swimmer touching said touch panel, said touch panel comprising a rear panel having a vertical portion having a switch portion and a horizontal portion bent at a bending portion from said vertical portion, a front panel disposed opposite to said vertical portion of said rear panel, a top edge panel fixed at one end on the upper part of said front panel and covering the bending portion of said rear panel, and an elastic member disposed between said rear panel and said top edge panel and having a bending angle which is more acute than that of said bending portion of said rear panel in order to elastically support said top edge panel and being located so as to touch said switch portion for actuating an electric switch when said top edge panel is pressed obliquely;

a control device having at least a timing cicuit for clocking the time in response to said start signal, said starting block signal, and said touch signal; and a recording device for recording the time outputted from said control device.

2. A timing system for a swimming race as claimed in claim 1, wherein a tubular tape switch actuated by pressure of said front panel is inserted into each of a plurality of sheaths provided on a surface of said vertical portion of said rear panel.

3. A timing system for a swimming race as claimed in claim 2, wherein said sheaths are made out of a material which lets water through.

4. A timing system for a swimming race as claimed in claim 2, wherein a frame having holes to drain water is provided at an outer peripheral portion of said rear panel so as to be attached and removed.

5. A timing system for a swimming race as claimed in claim 2, wherein ends of said tape switch comprise a welding portion and a sealing portion made of a sealing material to coat said welding portion.

6. A timing system for a swimming race as claimed in claim 1, further comprising a signal distributor for distributing said starting block signal from said starting block signal generator and said touch signal from said touch panel to a main lane box and to a sub lane box provided for each lane of the swimming pool, said main lane boxes being serially connected by one cable for inputting said starting block signal and said touch signal to said control device of said main lane boxes, and said sub lane boxes being serially connected by one cable for inputting said starting block signal and said touch signal to a sub control device.

7. A timing system for a swimming race as claimed in claim 1, wherein said control device includes a mask circuit for masking said touch signal from said touch signal in response to a first signal from said starting block signal generator generated by diving of a swimmer and for unmasking said touch signal from said touch panel in response to a second signal from said starting block signal generator generated by a swimmer stepping up onto a starting block.

8. A timing system for a swimming race as claimed in claim 1, wherein said control device includes a counting circuit for counting a number of swimmers waiting for their turns in relay after getting a first signal from said starting block signal generator generated by diving of a swimmer.

9. A timing system for a swimming race as claimed in claim 1, further comprising a visual display device for displaying visually a sign of ready and start after inputting a ready signal and a start signal to said control device.

10. A timing system for a swimming race as claimed in claim 9, wherein said visual display device makes a colored sign showing ready different from a colored sign showing start.

11. A timing system for swimming race as claimed in claim 9, wherein said visual display device is provided at, at least, one of a tip of said starting block and a turn side of the swimming pool.

12. A touch panel for suspension on the wall of a swimming pool for generating a touch signal when touched by a swimmer, the touch panel comprising: a rear member having a vertical portion, and a support portion connected to the vertical portion and supportable on an edge of a swimming pool so that the vertical portion is suspended on a wall of the swimming pool; a front member spaced from and opposed to the vertical portion of the rear member and movable vertically and horizontally relative to the rear member; a top edge member having a front end connected to an upper part of the rear member vertical portion, the top edge member extending rearwardly to cover the space between the front and rear members; switch means mounted in the space between the front and rear members and actuatable in response to rearward horizontal movement of the front member caused by a swimmer touching the front member for generating a touch signal; and elastic biasing means movably disposed in a space defined by the front, rear and top edge members for biasing the top edge member and thus the front member vertically upwardly, the elastic biasing means being responsive to a force applied obliquely to the top edge member by a swimmer to enable rearward horizontal movement of the front member to acutate the switching means and being responsive to a force applied vertically downwardly to the top edge member to enable vertical downward movement of the front member without effecting actuation of the switching means.

13. A touch panel according to claim 12; wherein the elastic biasing means comprises an elastic member having a first portion extending rearwardly between the top edge member and the support portion of the rear member, and a second portion extending downwardly in the space between the front member and the vertical portion of the rear member.

14. A touch panel according to claim 13; wherein the first and second portions of the elastic member are connected together at an acute angle which is more acute than the angle at which the vertical and support portions of the rear member are connected together.

15. A touch panel according to claim 12; wherein the switching means comprises at least one tubular tape switch mounted on the rear panel vertical portion.

16. A touch panel according to claim 12; further including, in combination therewith: a start signal generator for generating a start signal denoting the start of a swimming race; a starting block signal generator for generating a starting block signal in response to a swimmer's feet leaving a starting block; and a control device having a timing circuit for clocking the time in response to the start signal, the starting block signal and the touch signal.

17. A touch panel according to claim 16; wherein the elastic biasing means comprises an elastic member having a first portion extending rearwardly between the top edge member and the support portion of the rear member, and a second portion extending downwardly in the space between the front member and the vertical portion of the rear member.

18. A touch panel according to claim 17; wherein the first and second portions of the elastic member are connected together at an acute angle which is more acute than the angle at which the vertical and support portions of the rear member are connected together.

19. A touch panel according to claim 16; wherein the switching means comprises at least one tubular tape switch mounted on the rear panel vertical portion.

* * * * *